United States Patent [19]

Urban

[11] 3,969,829

[45] July 20, 1976

[54] DEHYDRATION

[76] Inventor: William C. Urban, 2765 Glen Mawr Road, Jacksonville, Fla. 32207

[22] Filed: July 23, 1974

[21] Appl. No.: 490,971

[52] U.S. Cl. ..... 34/93; 126/270
[51] Int. Cl.[2] ..... F26B 19/00
[58] Field of Search ..... 34/80, 93, 218; 126/270, 271; 237/1 A

[56] References Cited

UNITED STATES PATENTS

| | | | |
|---|---|---|---|
| 1,233,974 | 7/1917 | Burlen | 34/93 |
| 1,300,670 | 4/1919 | Stevens | 34/93 |
| 1,362,216 | 12/1920 | Barnard et al. | 34/93 |
| 1,538,957 | 5/1925 | Smith | 34/93 |
| 2,836,339 | 5/1958 | Pringle | 229/35 |
| 3,097,077 | 7/1963 | Melikian | 34/93 |
| 3,244,186 | 4/1966 | Thomason et al. | 126/270 |

OTHER PUBLICATIONS

"Field-Curing Burley Tobacco Under Plastic", Yoder; Article in Transactions of the Asae 1970, pp. 382–384.

*Primary Examiner*—Kenneth W. Sprague
*Assistant Examiner*—James C. Yeung

[57] ABSTRACT

This invention relates to a novel device for converting sunlight to heat, which is used to dehydrate solid organic material, which thereby is made useful as low - grade solid fuel or partly dehydrated foodstuffs.

6 Claims, 3 Drawing Figures

DEHYDRATION

This device consists of a thin sheet of metal in which has been cut small openings, raised a short distance above and parallel to the ground by props of material of low thermal conductivity. Also part of the device is a thin sheet of black flexible plastic which is placed over solid organic material to be dehydrated, which has previously been placed on the thin sheet of metal. Also part of the device are suitable rigid strips of material for holding the plastic sheet down around the edges of the area of the organic material. Also, if necessary, part of the device are suitable weights, to hold down the rigid strips of material.

Figure 1:
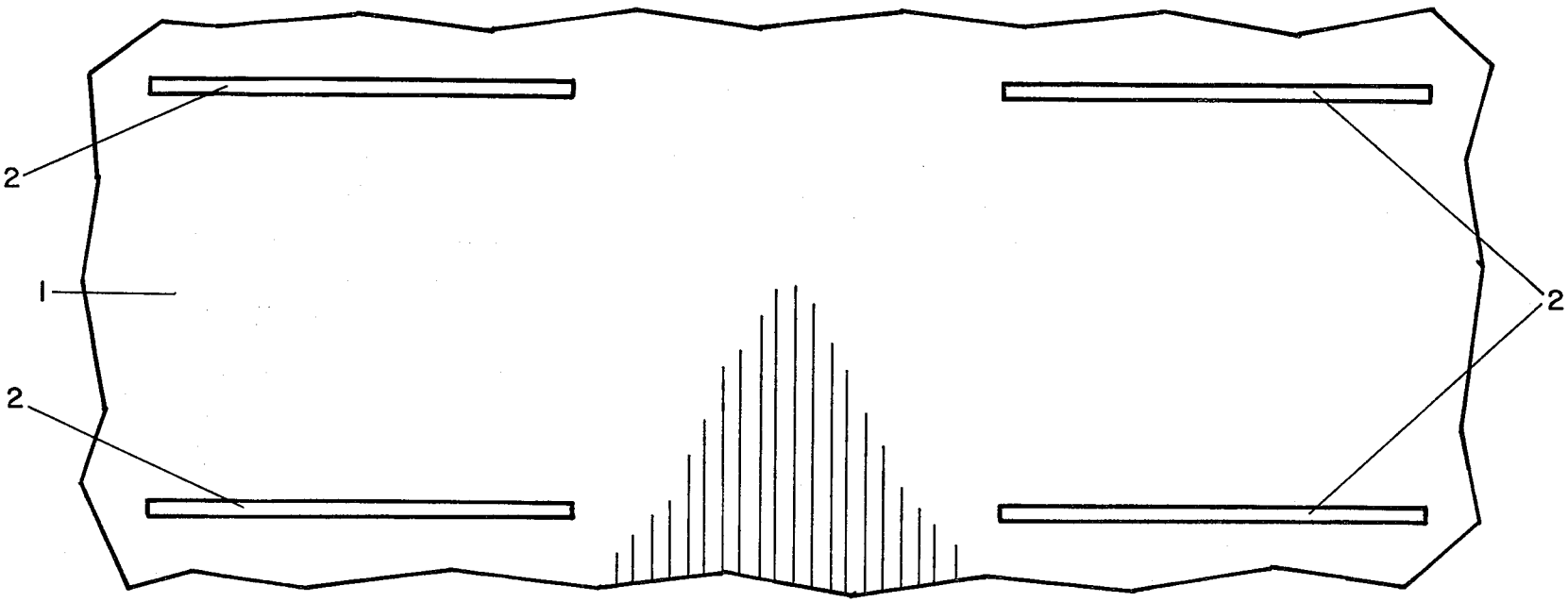
FIG. 1 is an enlarged cutaway section of the metal sheet, showing the arrangement of the openings.
Figure 2:
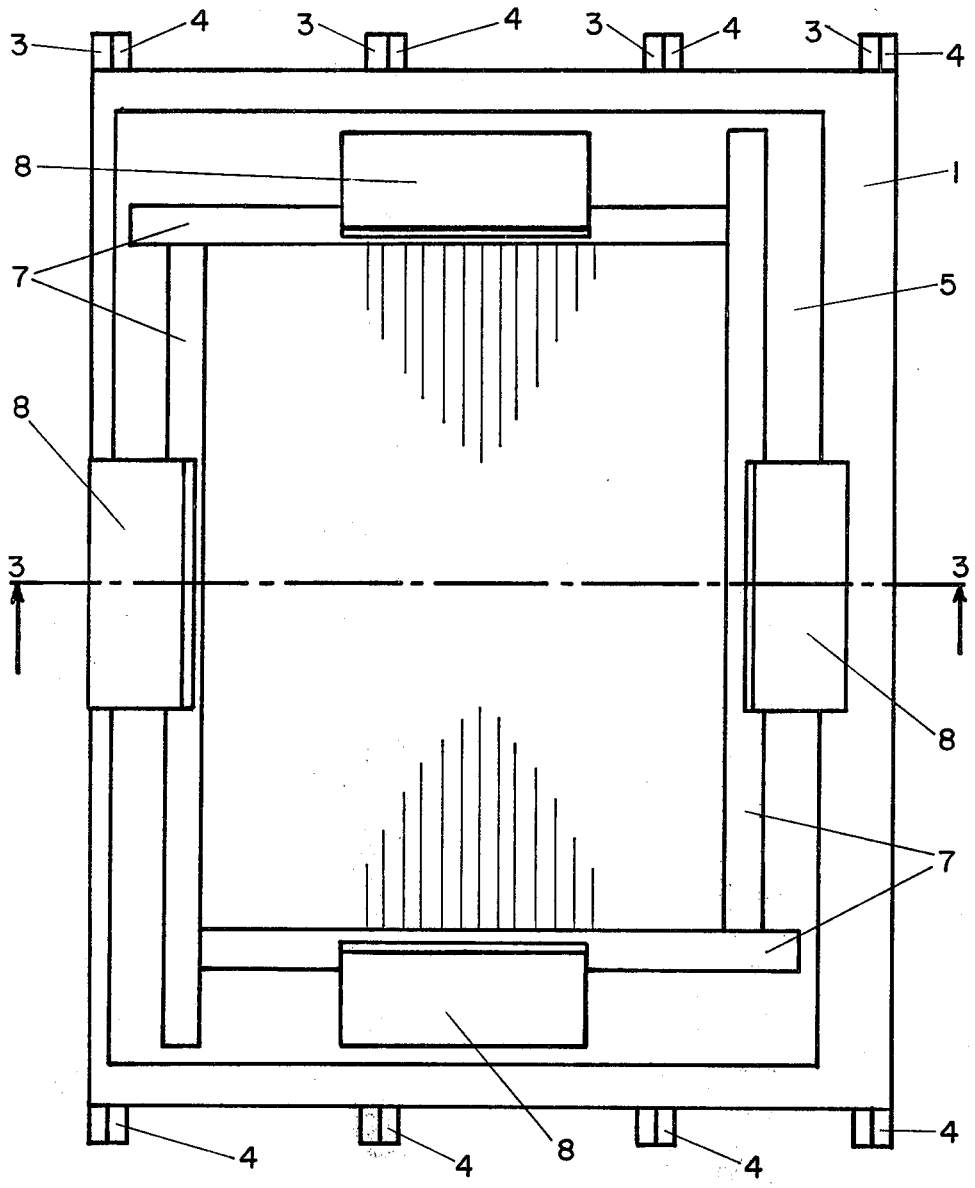
FIG. 2 is a top view of the device completely assembled.
Figure 3:
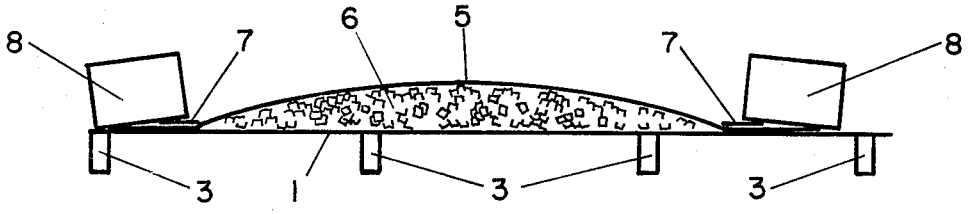
FIG. 3 is a transverse section taken on line 3—3 of FIG. 2.

The metal sheet 1 used is 28 gauge galvanized steel. The openings 2 are rectangular slots approximately 0.15 cm. by 4.0 cm. arranged lengthwise in rows such that the edge of each slot is 4 cm. from the corresponding edge of the slot in the next row. Each slot is 4 cm. from the next in its row. The slots are not staggered. This slot design covers practically the entire surface of the metal sheet 1 (34 inches by 26½ inches).

The metal sheet 1 is held off the ground by four wood boards 3 whose cross sections are ¾ inch by 1 ¾ inches. In cross section, they stand upright. Alongside each end of each board 3 is nailed a short board 4 of the same cross section to increase stability.

The plastic sheet 5 is 0.0038 cm. thick black flexible plastic. It is held down around the edges of the area of the organic material 6 by four thin metal strips 7. The metal strips are each held down by one small brick 8.

When in operation, sunlight falling upon the black plastic sheet 5 is converted to heat, which vaporizes water in the organic material 6. The resulting vapor is expelled from the device through the small openings 2 in the thin metal sheet 1.

In the two following experiments, because of shading from trees, the periods of potential sunlight were, respectively, approximately 10:15 AM to 5:50 PM and 10:20 AM to 5:55 PM Eastern Daylight Time. The device was placed at 30° 18′ 9″ North Latitude. Except when raining, during the period of potential sunlight, every hour on the hour was taken measurements of air temperature, temperature under the plastic sheet, and solar intensity. The temperature under the plastic sheet was measured by a thermometer which was kept inserted partway through a snug hole in the plastic sheet, the bulb of the thermometer being kept approximately halfway between the metal sheet and the plastic sheet. This thermometer is not part of the invention, but merely an instrument used to obtain experimental readings. An asterisk (*) following a time indicates that the hour following the time had overcast sky, which is here defined as an hour of time in which the solar intensity is reduced to less that 550 candles per square foot for a total of more than 10 minutes.

In order to illustrate this invention but without being limited thereto, the following examples are given.

EXAMPLE 1

970.8 gm. of waste corn material (This consists of the husk and the silk from ten ears of sweet corn and also the cobs, after the shucked ears of corn have been boiled in water for approximately fifteen minutes and have had the kernels eaten from them.) was cut into 1 – 2 gm. pieces and placed in the solar dehydration device to a depth of approximately 3 cm., to form a rectangle approximately 43 cm. by 56 cm., at approximately 11:00 AM June 20, 1974. The material was left in the solar dehydration device June 20, 21, 22, 23, and 24, 1974. During that time, the following data was obtained.

| Time (EDT) | Air Temperature (°C) | Temperature under plastic sheet (°C) | Solar intensity (candles/ft.²) |
|---|---|---|---|
| June 20, 1974 | | | |
| Noon | 35 | 61 | 600 |
| 1:00 PM | 39 | 67 | 600 |
| 2:00 PM | 37 | 66 | 600 |
| 3:00 PM | 37 | 65 | 600 |
| 4:00 PM | 35 | 60 | 600 |
| 5:00 PM | 33 | 53 | 600 |
| June 21, 1974 | | | |
| 11:00 AM | 31 | 52 | 600 |
| Noon | 33 | 60 | 600 |
| 1:00 PM | 35 | 63 | 600 |
| 2:00 PM | 37 | 66 | 600 |
| 3:00 PM | 38 | 61 | 600 |
| 4:00 PM | 38 | 56 | 600 |
| 5:00 PM* | 36 | 53 | 600 |
| June 22, 1974 | | | |
| 11:00 AM | 32 | 53 | 600 |
| Noon | 33 | 58 | 600 |
| 1:00 PM | 36 | 60 | 600 |
| 2:00 PM | 37 | 62 | 600 |
| 3:00 PM | 38 | 61 | 600 |
| 4:00 PM | 35 | 48 | 600 |
| 5:00 PM | 36 | 55 | 550 |
| June 23, 1974 | | | |
| 11:00 AM | 31 | 46 | 600 |
| Noon | 32 | 55 | 600 |
| 1:00 PM | 33 | 62 | 600 |
| 2:00 PM* | 36 | 63 | 400 |
| 3:00 PM* | 29 | 44 | 275 |
| 4:00 PM | 33 | 53 | 600 |

-continued

| Time (EDT) | Air Temperature (°C) | Temperature under plastic sheet (°C) | Solar intensity (candles/ft.²) |
|---|---|---|---|
| 5:00 PM* | 32 | 47 | 300 |
| June 24, 1974 | | | |
| 1:00 PM* | 24 | 26 | 325 |

The declination of the sun on the days of this experiment was, respectively, +23° 25′ 52.1″, +23° 26′ 23.6″, +23° 26′ 30.4″, +23° 26′ 12.4″, and +23° 25′ 29.6″. Therefore, the closest approaches of the sun to zenith on these days were, respectively, 6° 52′ 16.9″, 6° 51′ 45.4″, 6° 51′ 38.6″, 6° 51′ 56.6″, and 6° 52′ 39.4″.

The device was subjected to a light drizzle from approximately 2:30 PM to 2:43 PM June 23, 2974. Immediately after the drizzle stopped, practically all the water was wiped from the plastic sheet with a paper towel.

The device was subjected to light showers and drizzle approximately 11:00 AM to 11:45 AM, 11:55 AM to 12:45 PM, and 1:00 PM to after 6:00 PM June 24, 1974. Therefore, the entire span of time for readings that day had overcast sky, and the only readings taken were for 1:00 PM.

At approximately 6:00 PM June 24, 1974, the plastic sheet was lifted and the partly dried waste corn material was removed from the device. It weighed 456.2 gm. Therefore, the loss of weight, representing water driven off, was 53%. The heat of combustion of the material was 3.253 kilocalories/gm. (5,856 B. T. U./pound).

EXAMPLE 2

1,966.7 gm of freshly shelled dent corn (field corn) kernels containing 53.6% by weight water were placed in the solar dehydration device to a depth of approximately 3 cm., to form a rectangle approximately 37 cm. by 50 cm., at approximately 11:55 AM July 13, 1974. The kernels were left in the solar dehydration device July 13, 14, 15, 16, and 17, 1974. During that time, the following data was obtained.

| Time (EDT) | Air Temperature (°C) | Temperature under plastic sheet (°C) | Solar intensity (candles/ft.²) |
|---|---|---|---|
| July 13, 1974 | | | |
| 1:00 PM | 35 | 56 | 600 |
| 2:00 PM | 35 | 62 | 600 |
| 3:00 PM* | 32 | 57 | 400 |
| 4:00 PM | 33 | 56 | 500 |
| 5:00 PM | 30 | 52 | 600 |
| July 14, 1974 | | | |
| 11:00 AM | 31 | 40 | 600 |
| Noon | 34 | 55 | 600 |
| 1:00 PM | 33 | 61 | 600 |
| 2:00 PM | 34 | 65 | 600 |
| 3:00 PM | 35 | 63 | 600 |
| 4:00 PM | 34 | 62 | 600 |
| 5:00 PM | 31 | 57 | 600 |
| July 15, 1974 | | | |
| 11:00 AM | 29 | 45 | 600 |
| Noon | 29 | 47 | 550 |
| 1:00 PM | 32 | 56 | 600 |
| 2:00 PM | 34 | 63 | 600 |
| 3:00 PM | 34 | 61 | 600 |
| 4:00 PM | 35 | 61 | 500 |
| 5:00 PM | 35 | 56 | 550 |
| July 16, 1974 | | | |
| 11:00 AM | 32 | 46 | 550 |
| Noon | 33 | 56 | 600 |
| 1:00 PM | 35 | 61 | 600 |
| 2:00 PM | 37 | 60 | 600 |
| 3:00 PM | 38 | 63 | 600 |
| 4:00 PM | 38 | 62 | 600 |
| 5:00 PM | 36 | 56 | 550 |
| July 17, 1974 | | | |
| 11:00 AM | 32 | 49 | 600 |
| Noon | 33 | 58 | 600 |
| 1:00 PM | 37 | 63 | 600 |
| 2:00 PM | 36 | 65 | 600 |
| 3:00 PM | 38 | 66 | 600 |
| 4:00 PM | 39 | 63 | 600 |
| 5:00 PM | 35 | 58 | 550 |

The declination of the sun on the days of this experiment was, respectively, +21° 55′ 2.6″, +21° 46′ 22.0″, +21° 37′ 19.0″, +21° 27′ 53.8″, and +21° 18′ 6.7″. Therefore, the closest approaches of the sun to zenith on these days were, respectively, 8° 23′ 6.4″, 8° 31′ 47.0″, 8° 40′ 50.0″, 8° 50′ 15.2″, and 9° 0′ 2.3″.

At approximately 6:00 PM July 17, 1974, the plastic sheet was lifted and the partly dried dent corn kernels were removed from the device. They weighed 1,416.9 gm. therefore, the loss of weight, representing water driven off, was 28.0%. The partly dried kernels contained 38.8% by weight water. The percentage of broken or damaged kernels was negligible. Very little, if any, mustyness, sourness, or commercially objectionable foreign odor could be detected. No heating could be detected.

It is understood that the above detailed examples are given merely by way of illustration and that many variations may be made therein without departing from the spirit of this invention. For example, it would be within the spirit of this invention to use the solar dehydration device to dehydrate any solid organic material.

Having described my invention, what I desire to secure by Letters Patent is:

1. A solar dehydration device for solid organic material consisting of a. a thin metal sheet having a plurality of small openings therein, upon which organic material adapted to be placed;

b. prop means formed of a material having a low thermal conductivity for supporting said thin metal sheet in spaced relation from the ground;

c. a sheet of thin black flexible plastic adapted to be placed over the organic material;

d. solid rigid strips means engaging the entire peripheral edges of said thin black flexible plastic and said solid rigid strips means to hold the thin black plastic sheet down around the edges of the arena of said thin metal sheet to enclose the organic material between said plastic and said metal sheets;

e. and weights means engaging said solid rigid strips to maintain the solid strip means in engagement with the plastic and metal sheets to seal the flexible plastic sheet to peripheral edges of metal sheet so that the water vapor escaping from the organic material will be expelled solely through the opening in said thin metal sheet.

2. A solar dehydration device for solid organic material consisting of a. a thin metal sheet having a plurality of small openings therein, upon which organic material adapted to be placed;

b. prop means formed of a material having a low thermal conductivity for supporting said thin metal sheet in spaced relation from the ground;

c. a sheet of thin black flexible plastic adapted to be placed over the organic material;

d. solid rigid strips means engaging the entire peripheral edges of said thin black flexible plastic and said solid rigid strips means to hold the thin black plastic sheet down around the edges of the area of said thin metal sheet to enclose the organic material between said plastic and metal sheets;

e. said solid rigid strip having sufficient weight to maintain the solid rigid strips means in engagement with the plastic and metal sheets to seal the flexible plastic sheet to peripheral edges of metal sheet, so that the water vapor escaping from the organic material will be expelled solely through the opening in said thin metal sheet.

3. The device as recited in claim 1 wherein said solid organic material is waste corn.

4. The device as recited in claim 2 wherein said solid organic material is waste corn.

5. The device as recited in claim 1 wherein said solid organic material is shelled dent corn kernels.

6. The deviceas recited in claim 2 wherein said solid organic material is shelled dent corn kernels.

* * * * *